United States Patent [19]

Cosmos et al.

[11] 4,421,376

[45] Dec. 20, 1983

[54] SNAP-ON CABLE CLAMP

[75] Inventors: Pete Cosmos; Earl W. McCleerey, both of Mechanicsburg, Pa.

[73] Assignee: AMP Incorporated, Harrisburg, Pa.

[21] Appl. No.: 319,348

[22] Filed: Nov. 9, 1981

[51] Int. Cl.[3] ..... H01R 13/58

[52] U.S. Cl. ..... 339/103 M; 339/91 R

[58] Field of Search ..... 339/103 R, 103 C, 103 M, 339/105, 107, 97 R, 98, 206 R, 208, 210 R, 210 M

[56] References Cited

U.S. PATENT DOCUMENTS

| | | | |
|---|---|---|---|
| 3,904,265 | 9/1975 | Hollyday et al. | 339/103 M |
| 4,108,527 | 8/1978 | Doughty et al. | 339/107 |
| 4,169,643 | 10/1979 | Gallagher | 339/103 R |
| 4,284,317 | 8/1981 | Doyle | 339/103 R |

OTHER PUBLICATIONS

"Double Angle Strain Relief Clamp", E. C. Uberbacher, IBM Technical Disclosure Bulletin, vol. 3, No. 6, Nov. 1960.

*Primary Examiner*—Joseph H. McGlynn
*Assistant Examiner*—David L. Pirlot
*Attorney, Agent, or Firm*—Russell J. Egan

[57] ABSTRACT

A cable clamp assembly in which a cable clamping member is easily and rapidly secured to a housing of an electrical connector so that the cable extends therefrom in either a 90° or 180° direction as selected. The assembly includes a pair of members which are snap fitted in an assembly on the rear of an existing electrical connector, and a cable clamping member which is selectively positioned between the cover members providing 90° or 180° exit for the cable.

7 Claims, 6 Drawing Figures

SNAP-ON CABLE CLAMP

The present invention relates to a cable clamp assembly and in particular to an assembly which can be readily adapted for 90° or 180° cable exiting.

It is frequently desirable for an electrical connector to have a cable clamping attachment which may be provided to tightly secure the wires of a cable to the electrical connector so that the engagement of the wires of the cable with the contacts of the connector will not be damaged by excessive force applied to the cable. It is also desirable to have such cable clamping assemblies arranged so that they can be rapidly assembled with the connector and can provide alternative directions for exiting of the cable from the assembly.

An example of a known snap-on cable clamp assembly is shown in U.S. Pat. No. 3,483,309. This cable clamp is a two-piece assembly of a metal shell, and a cable clamping member. The cable clamping member can be positioned on the shell and either of two positions and snap fitted to the shell. The strain relief for the cable is provided by bolting the clamping member about the cable and the assembly must be bolted to the electrical connector receptacle.

According to the present invention, therefore, a cable clamping assembly as defined above is characterized in that strain relief and cable clamping for an existing electrical connector is provided by a three-piece assembly including first and second mating housing members and a cable engaging clamping member which is snap fitted to the other two members in either of two positions to appropriately direct the cable exiting from the assembly at either 90° or 180°. Accordingly, the present invention is made out of insulative material and is adopted to grippingly engage an electrical connector while snap fitting together in either of two configurations.

An embodiment of the present invention will now be described by way of example with reference to the accompanying drawings in which.

Figure 1:
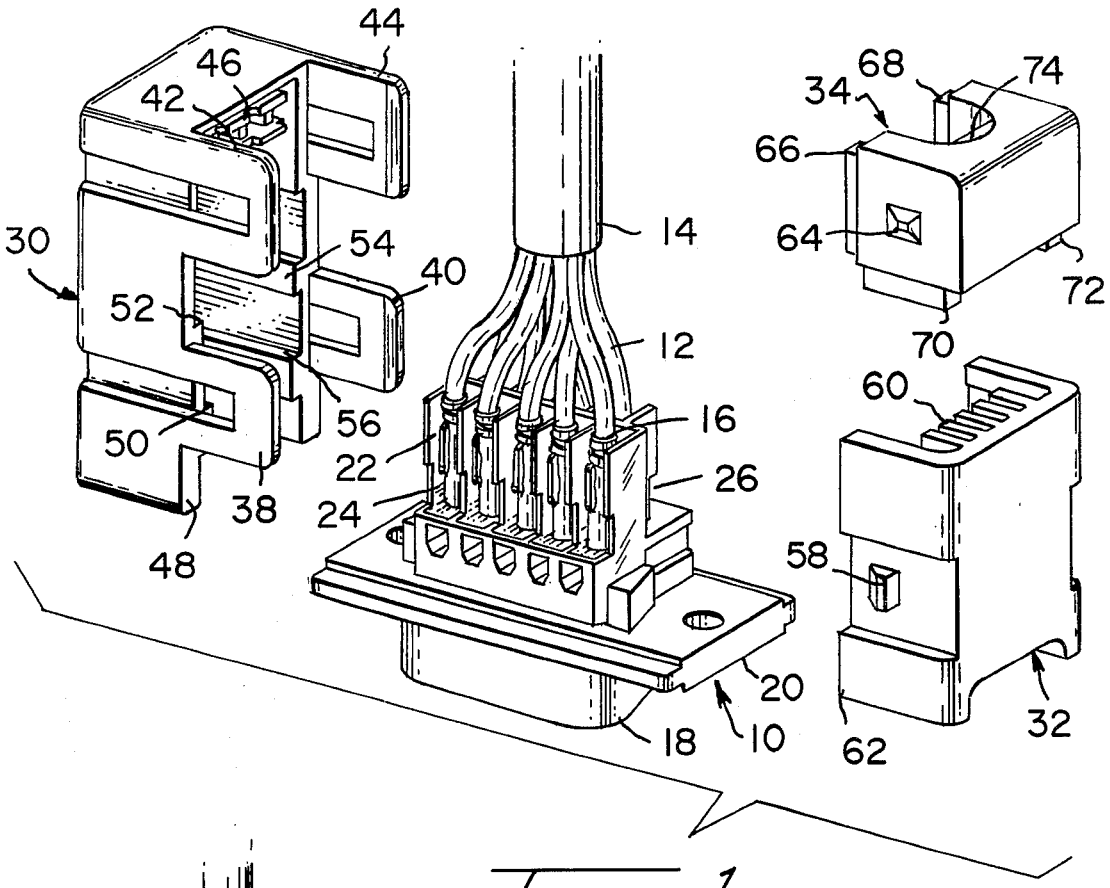
FIG. 1 is an exploded perspective view of the subject invention together with a known electrical connector terminating a multi-conductor cable.

The present invention is intended for use in providing strain relief for an electrical connector having an elongated profile. The illustrated electrical connector 10 is preferably of the type shown in my copending application Ser. No. 163,915 filed June 27, 1980, the disclosure of which is incorporated herein by reference. However, other well known connectors, such as shown in U.S. Pat. No. 3,002,176, or the terminal carrying housing of U.S. Pat. No. 4,243,288, could be used. The connector 10 terminates a plurality of individual conductors 12 of a cable 14 in a known fashion by terminals 16. Only portions of the terminals 16 can be seen in the present drawings. The terminals 16 would preferably be of the type shown in either the above-mentioned application or FIG. 3 of the previously mentioned U.S. Pat. No. 4,243,288, the disclosure of which is incorporated herein by reference. The illustrated connector 10 is formed of rigid insulative material with a mating face 18, a peripheral mounting flange 20, a plurality of parallel terminal channels 2, each of which is closed toward the mating face 18 and outwardly open toward the rear of the connector, and a pair of outwardly directed transverse grooves 24, 26 spaced intermediate the flange 20 and the rear of the connector.

The subject snap-on cable clamp assembly 28 is a three-piece assembly including a first large housing member 30, a second small mating housing member 32, and a cable clamping member 34. The housing members 30, 32 together define therein a chamber 36 (see FIGS. 4 and 5) which encloses the rear of the connector 10. The first large housing member 30 includes laterally extending latching ears 38, 40, 42, and 44, a transverse profiled cable engaging surface 46, an open end 48 profiled to closely engage the connector 10, and two pairs of spaced, opposed laterally extending interior ribs 50, 52, 54, 56. The second small housing member 32 has a pair of oppositely outwardly directed latching lugs 58, a cable engaging profile 60 at one end, an opposite open end 62 profiled to closely engage the connector 10, and two pairs of spaced, opposed laterally extending interior ribs (not shown) similar to and aligned with like ribs on the first large housing member. The cable clamping member 34 has a pair of outwardly directing latching lugs 64, first parallel, spaced housing engaging lugs 66, 68 on a first side, and second housing engaging lugs 70, 72 on a second adjacent side, and a profiled cable exit 74.

Figure 2:
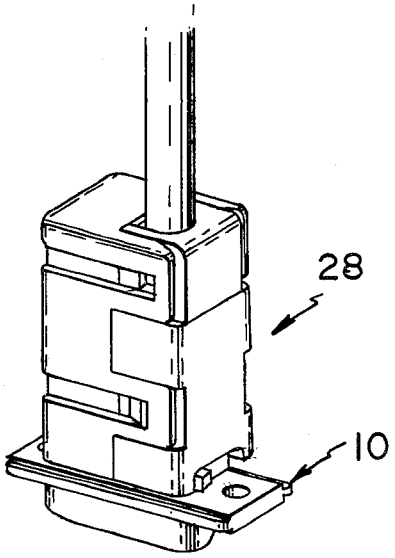
FIG. 2 is a perspective view of the subject invention assembled in a 180° cable exiting condition.
Figure 3:
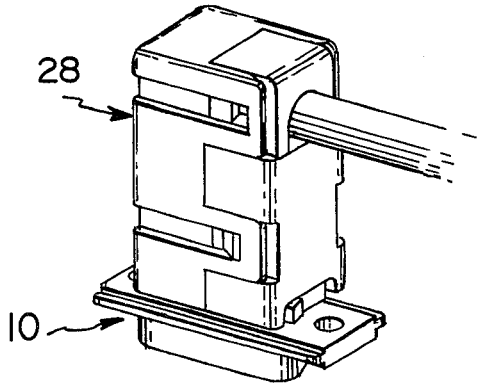
FIG. 3 is a perspective view similar to FIG. 2 but with the invention assembled in the 90° exiting condition.
Figures 4, 5:
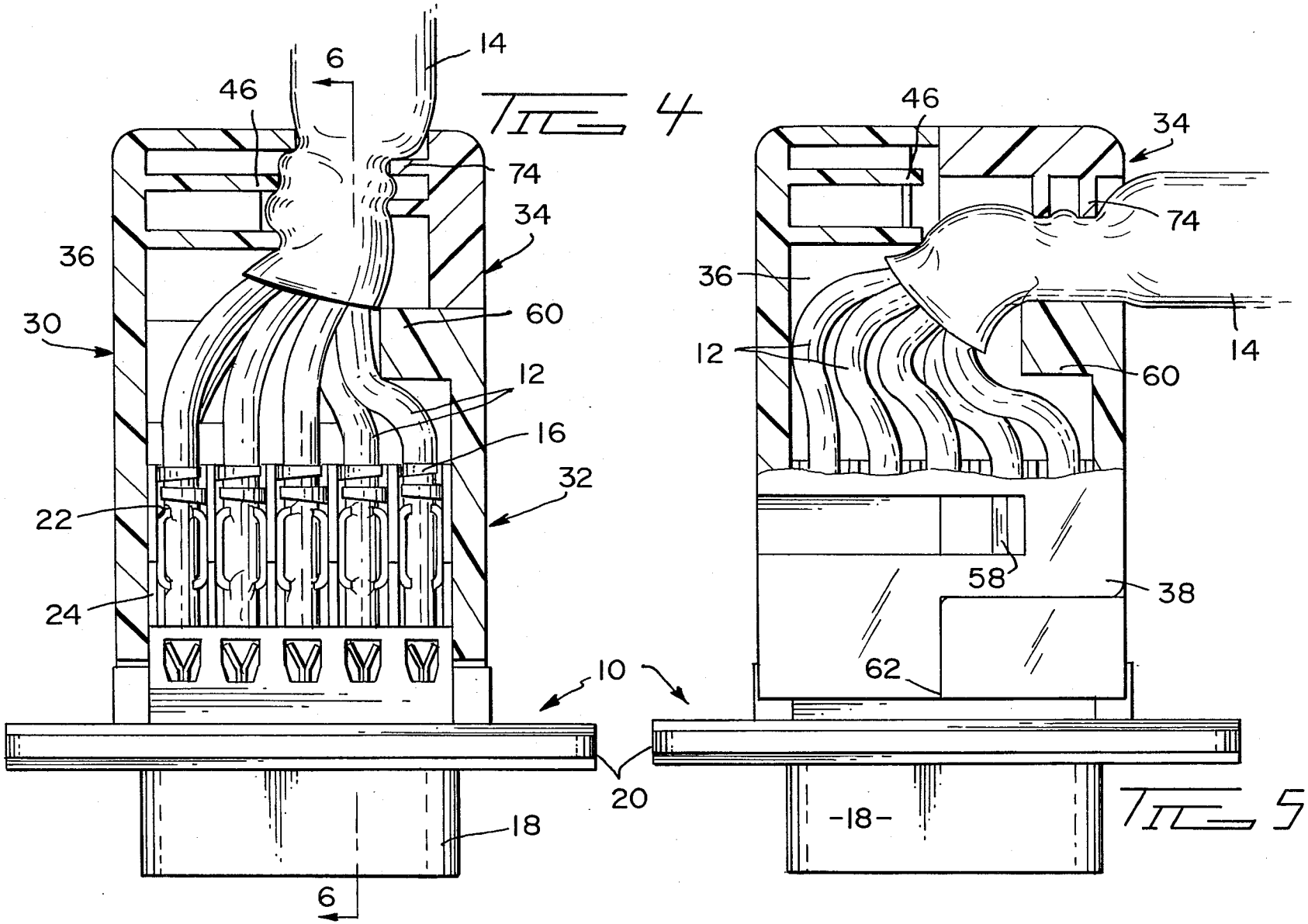
FIG. 4 is a longitudinal section through the subject invention as shown in FIG. 2.
FIG. 5 is a side elevation, partially in section, of the subject invention and the condition shown in FIG. 3.
Figure 6:
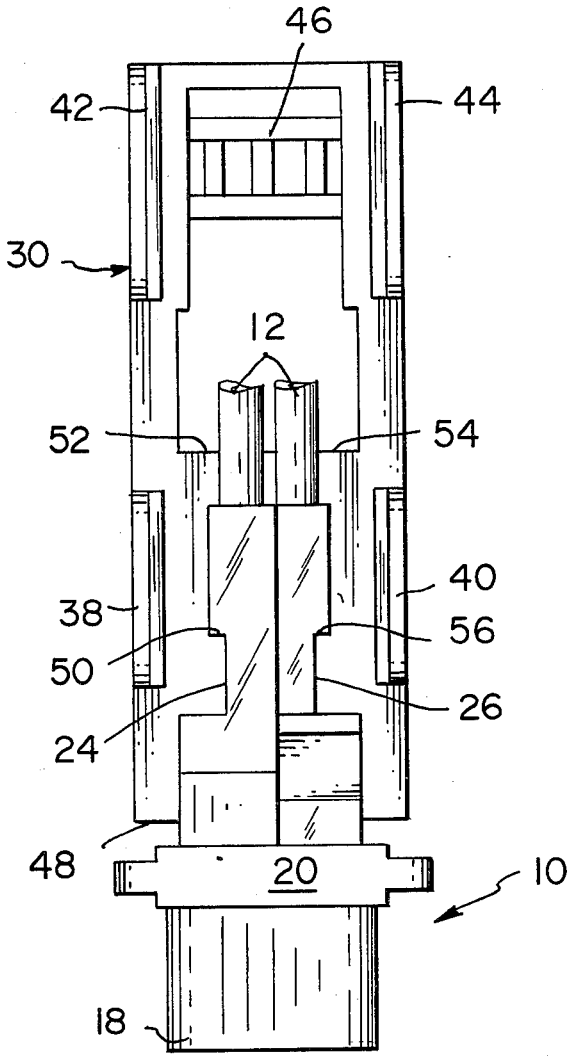
FIG. 6 is a transverse section taken along line 6—6 of FIG. 4.

The subject invention is utilized as follows. The conductors 12 of a cable 14 are terminated in a known manner and the terminals 16 of a known connector 10. The housing members 30, 32 are then placed about the rear of the connector 10 with the open ends 48, 62 engaging the rear portion of the connector 10 behind flange 20 and ribs 50, 56 sliding in grooves 24, 26, respectively. The first and second housing members 30, 32 are snap fitted together by engagement of the latching ears 38, 40 with the respective lugs 58. The direction of the cable exit must then be determined for either 90° exit, as shown in FIGS. 3 and 5, or 180° exit as shown in FIGS. 1, 2, and 4. Assuming the 180° exiting, the cable 14 would be placed against the profiled surface 46 and the cable clamp 34 would be applied to the respective housings with the lugs 66, 68 entering into the first housing 30 and the lugs 70, 72 entering into the second housing 32. The lugs 64 would make engagement with the latching ears 42, 44 to securely hold the clamping member 34 in the assembly and to firmly clamp the cable 14 between the surface 46 of the first housing 30 and the surface 74 of the clamp 34.

It will be readily appreciated that if 90° exiting is desired, it is only necessary to reverse the position of the clamping member 34 as shown in FIGS. 3 and 5.

We claim:

1. A snap-on cable clamp assembly providing 90° of 180° cable exiting from an electrical connector, said cable clamp assembly comprising:

first and second mating housing members of substantially rectangular configuration defining therebetween a connector receiving cavity, said housing members having like width and depth but substantially different lengths to define an enlarged cable exit opening from the assembled housing members in two directions normal to each other, each said housing member having a cable gripping profile directed towards said cable exit, and means to latchingly engage said housing members; and a cable clamp having a width and depth equal to said housing members and length equal to the difference in length of said housing members, said cable clamp having a cable gripping profile on a first side, and adjacent housing members engaging second and third sides, and means to latchingly engage said first and second housing members, whereby with said second side engaging said first housing member and said third side engaging said second housing member 180° cable exiting is achieved while with said second side engaging said second housing member and said third side engaging said first housing member 90° cable exiting is achieved.

2. A snap-on cable clamp assembly according to claim 1 wherein said means to latchingly engage said first and second housing members comprises lugs on said cable clamp received in latching means of at least one of said housing members and integral flanges extending from said second and third sides received in a respective housing member.

3. A snap-on cable clamp assembly accrding to claim 1 wherein each said housing member further comprises means to grippingly engage said electrical connector.

4. In combination with an elongated electrical connector having a mating face, a rear portion opposite the mating face, a plurality of terminal passages extending between said rear portion and said mating face, a terminal in each respective passage, and at least one transverse groove extending across said rear portion, a snap-on cable clamp assembly capable of providing 90° or 180° cable exiting, said clamp assembly comprising:

first and second mating housing members of substantially rectangular configuration together defining a cavity having one open end to receive said connector therein, said housing members being of like width and depth but of substantially different lengths to define a two directional cable exit at the end remote from said open end, latching means to detachably secure said housing members together, and at least one inwardly directed rib on each said housing member adapted to slidingly engage a respective transverse groove of said electrical connector; and a cable clamp member of width and depth equal to said housing members and length equal to the difference in length between said housing members, one side of said cable clamp member having a cable gripping profile, second and third sides of said cable clamp member having housing member engaging profiles whereby with said second side engaging said first housing member and said third side engaging said second housing member said cable clamp member provides 180° cable exiting and with said second side engaging said second housing member and said third side engaging said first housing member said cable clamp member provides 90° cable exiting.

5. The combination according to claim 4 further comprising means to latchingly engage said first and second housing members.

6. The combination according to claim 4 wherein each said housing member further comprises means defining a cable engaging surface in each said housing member at the end opposite said open end.

7. The combination according to claim 4 further comprising means to latchingly engage said cable clamp member in said housing members.

* * * * *